United States Patent [19]

Kilbert

[11] 4,386,969

[45] Jun. 7, 1983

[54] FERROUS ALLOY AND ABRASION RESISTANT ARTICLES THEREOF

[75] Inventor: Robert K. Kilbert, Racine, Wis.

[73] Assignee: Harris Metals, Inc., Racine, Wis.

[21] Appl. No.: 279,427

[22] Filed: Jul. 1, 1981

Related U.S. Application Data

[63] Continuation-in-part of Ser. No. 134,643, Mar. 27, 1980, abandoned.

[51] Int. Cl.[3] ..... C21C 1/00; C21D 1/18

[52] U.S. Cl. ..... 148/3; 148/35; 277/96.2

[58] Field of Search ..... 277/96.2; 75/126 A, 75/126 B, 126 C, 126 E, 126 H, 123 CB; 148/35, 3

[56] References Cited

U.S. PATENT DOCUMENTS

| | | | |
|---|---|---|---|
| 2,709,132 | 5/1955 | Giles | 75/126 A |
| 3,067,026 | 12/1962 | Barrett et al. | 75/126 A |
| 3,940,154 | 2/1976 | Olsson | 277/9 |
| 4,094,514 | 6/1978 | Johnson | 277/92 |
| 4,116,724 | 9/1978 | Hirschfeld et al. | 148/3 |

FOREIGN PATENT DOCUMENTS

| | | | |
|---|---|---|---|
| 47-29091 | 7/1972 | Japan | 148/3 |
| 51-59007 | 5/1976 | Japan | 75/126 A |

OTHER PUBLICATIONS

*Metal Progress 1978 Databook,* p. 19, TS 300 M587 (Mid June, 1978).

*Primary Examiner*—Michael L. Lewis
*Attorney, Agent, or Firm*—James E. Nilles

[57] ABSTRACT

An abrasion resistant alloy consists essentially of (by weight):

| | |
|---|---|
| carbon | 2.75–3.25% |
| chromium | 18.00–22.00% |
| molybdenum | 3.50–6.50% |
| silicon | up to 1% |
| manganese | up to 1% |
| cobalt | 1.50–4.00% |
| vanadium | up to 2.00% |
| iron | balance |

with not substantially more than trace quantities of sulfur, phosphorous and tungsten. The alloy is suitable for forming into sealing rings of grit seal assemblies, which rotate relative to one another and have coaxial, axially opposing, flat annular sealing surfaces that are maintained engaged under bias. Although relatively soft as cast, the alloy can be brought to hardness suitable for final drive grit seals by heating to 950°–1015° F., and can be brought to maximum hardness—adequate for mud seals—by heating to 1750°–1800° F., with cooling in ambient air in each case.

5 Claims, 1 Drawing Figure

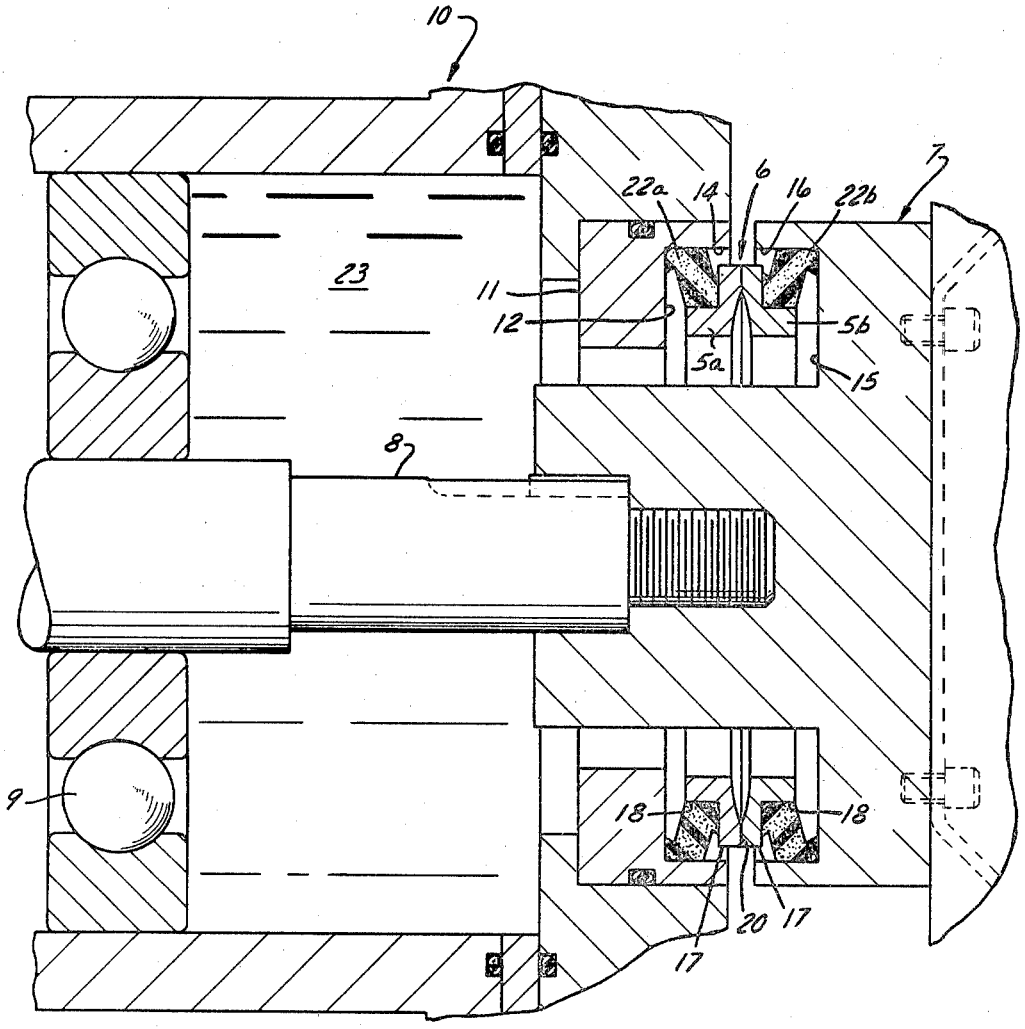
10
7
22a
14
6
16
22b
23
11
12
5b
5a
15
8
9
18
18
20
17
17

FERROUS ALLOY AND ABRASION RESISTANT ARTICLES THEREOF

RELATED APPLICATION

This application is a continuation-in-part of copending application Ser. No. 134,643, filed Mar. 27, 1980, abandoned after the filing hereof.

FIELD OF THE INVENTION

This invention relates generally to a ferrous metal alloy having high resistance to abrasion, and the invention is more particularly concerned with an alloy that contains relatively small amounts of critically scarce alloy metals and with articles such as sealing rings for mud seal assemblies that are made from said alloy.

BACKGROUND OF THE INVENTION

A typical and very important use for abrasion resistant ferrous alloys of the general type here under consideration is for sealing rings in mud seal assemblies of earth moving machines and the like. Such an assembly, as exemplified by U.S. Pat. No. 3,940,154, comprises a pair of coaxial metal sealing rings which rotate relative to one another and which have axially opposing annular sealing surfaces that are lapped to accurate flatness and are engaged with one another under bias. The lapped surfaces of the sealing rings are maintained in sealing engagement by elastomeric rings, one for each of the metal rings, whereby the metal rings are held in coaxial relation to one another and to other parts. Each of the elastomeric rings also serves to transfer torque to its metal ring, so that relative rotation occurs only at the seal between the engaged annular surfaces of the metal rings and not between the metal rings and the elastomeric rings or between the latter and their holders.

The metal sealing rings in such a seal assembly must be extremely hard to resist abrasion under the friction which they impose upon one another by their relative rotation. They must also resist surface galling and should not have a tendency to seize after extended periods of rest or non-use. At least their rotatably engaged sealing surfaces must also be resistant to corrosion in the presence of salt water and the like. Furthermore, they must retain their significant physical properties notwithstanding subjection to mechanical shocks and other adverse conditions including extremes of environmental temperatures ranging from arctic conditions on the order of minus 40° F. to desert temperatures on the order of 120° F.

One abrasion resistant alloy heretofore used for mechanical sealing rings in mud seal applications was commercially known as "Haynes 93". It was highly satisfactory from the standpoint of its ability to resist wear in a gritty environment, but it was also extremely expensive in that its composition, as set forth in U.S. Pat. No. 4,094,514, included about 6.5% cobalt, 16% molybdenum, 17% chromium and a little under 2% of vanadium. While all of these alloying materials are more or less expensive, molybdenum and cobalt are particularly critical. About 95% of the cobalt used in the United States is imported, and the quantities available here are so limited that users are sold only restricted allocations of it. Although the major suppliers of molybdenum are in the United States, world-wide demand exceeds the available supply, and molybdenum, too, is subject to allocations. There have been times in the recent past when allocations of these alloying metals have restricted the number of castings that could be produced.

In a sense, "Haynes 93" was better than necessary because sealing rings made from that alloy outlasted the bearings that they protected. Since the sealing assembly must be discarded when bearings are replaced, the use of "Haynes 93" for mud seal sealing rings represented a certain amount of waste of critically scarce alloy metals.

A somewhat less expensive abrasion resistant alloy, commercially designated "Haynes 589", was disclosed in U.S. Pat. No. 3,067,026. "Haynes 589" required an acceptably low percentage of cobalt, but it contained an undesirably high 12% to 20% of almost equally critical molybdenum. "Haynes 589" was particularly intended for use in nuclear reactors, but it found some application in seal rings, although it could not be used for all seal ring applications because it shows less wear resistance than "Haynes 93".

An abrasion resistant alloy less expensive than "Haynes 589", disclosed in U.S. Pat. No. 4,094,514 (applied for in 1977) is commercially known as "CR-19". Less molybdenum is needed for "CR-19" than for either "Haynes 93" or "Haynes 589". "CR-19" includes 0.25% to 1.25% of critical cobalt; and this compares favorably with the 5.5% to 7% of cobalt specified for "Haynes 93". However, "CR-19" also requires from 1.75% to 3% of tungsten, which is expensive and which tends to give rise to foundry problems when incorporated into alloys of the type here under consideration because it causes the molten metal to be relatively sluggish.

"CR-19" is slightly less wear resistant than "Haynes 589". Because of this comparative lack of wear resistance, the use of "CR-19" in mud seals has heretofore been confined to inexpensive short-life seals for specific applications. "CR-19" is not regarded as suitable for final drive seals nor for mud seals where long seal life is required. Mud seals are those which are directly adjacent to endless treads or are in similar locations where they are constantly exposed to grit; whereas final drive seals are located in drive hubs where they are better protected from abrasive foreign matter but are still exposed to some grit. Typically, seal rings for mud seal assemblies are not over about 6 in. (150 mm.) in diameter, while final drive seal rings have diameters of about 12 in. (300 mm.) and upwards.

It will be apparent that there has been an urgent need for an abrasion resistant alloy which requires less of the critical and expensive alloying materials—particularly cobalt and molybdenum—than "Haynes 93" or "Haynes 589" but which is nevertheless sufficiently more wear resistant than "Haynes 589" to be suitable for use in long-life sealing rings of mud seal assemblies. To be suitable for all categories of sealing rings, such an alloy does not have to be quite as wear resistant as "Haynes 93", but its cost and its content of critical alloy metals should compare favorably with those of "Haynes 589" and "CR-19".

The art has thus been confronted for a number of years with an urgent need for an abrasion resistant alloy having a combination of physical and economic characteristics that suit it for all categories of metal sealing rings and containing small enough percentages of cobalt and molybdenum to effectively extend the critically small supply of those alloying metals. This problem has had no solution that was obvious to those skilled in the art, as is apparent from the fact that production of alloys suitable for grit seal rings has for some time been limited by the availability of the critical metals and has been insufficient to satisfy demands. Having in mind that, among other uses, such grit seal rings can find application in mechanized military equipment, it can be appreciated that there has been an active search for a solution to the problem.

SUMMARY OF THE INVENTION

The general object of this invention is to provide an abrasion resistant alloy which is wear resistant enough for seal rings for heavy-duty grit seals but which is comparable with "CR-19" with respect to its cost and its content of critically scarce alloy metals, particularly cobalt and molybdenum, so as to be economically suitable for all categories of sealing rings.

Since every known sealing ring alloy—including the one of this invention—includes some quantity of either cobalt or molybdenum or both, and since the available quantities of those alloy metals are rather rigidly limited, it is another object of this invention to provide an abrasion resistant alloy which is suitable for all types of sealing rings and which, with given allotments of critical metals, can be produced in substantially larger quantities than prior alloys suitable for the same purposes.

It is also an object of this invention to provide a wear resistant alloy which does not incorporate tungsten and which is therefore less likely to cause foundry problems (less misruns and cold shuts) than prior comparable alloys.

While the objects of the invention have here been discussed in terms of sealing rings for mud seal and final drive seal assemblies, it will be understood that such rings represent only one type of application for an abrasion resistant alloy, and that there are many other types of articles for which such an alloy is suitable; hence, it is generally an object of the invention to provide an abrasion-resistant iron-base alloy which is only slightly less wear resistant than "Haynes 93" and which, although comparing favorably in cost and in critical materials content with "CR-19", is nevertheless more wear resistant than "CR-19" and "Haynes 589".

It is also an object of the invention to provide an alloy which is relatively soft in as-cast condition—substantially softer, for example, than "CR-19"—but which attains a greater hardness than "Haynes 589" after being subjected to a simple heat treatment.

In general, these and other objects of the invention are achieved in a ferrous alloy composition that comprises, by weight, from about 2.75% to about 3.25% of carbon, from about 18% to about 22% of chromium, from about 3.5% to about 6.5% of molybdenum, up to 1% of silicon, up to 1% of manganese, from about 1.5% to about 4.0% cobalt, up to 2.0% of vanadium, not substantially more than trace quantities of phophorous, sulfur and tungsten, and the balance iron. For hardening, a part made with the alloy is heated to bring the temperature of substantially all portions thereof to substantially 950°–1025° F., or, for maximum hardening, to substantially 1750°–1800° F., with subsequent cooling in air at ambient temperature in each case.

BRIEF DESCRIPTION OF DRAWING

The accompanying drawing is a view in longitudinal section of a seal assembly comprising sealing rings that constitute a typical product into which the alloy of this invention is made.

DETAILED DESCRIPTION OF PREFERRED EMBODIMENT OF THE INVENTION

A typical use of the alloy of the present invention is for the sealing rings 5*a*, 5*b* of a mud seal assembly 6 like that illustrated in the accompanying drawing, wherein the seal assembly is associated with a rotatable member 7, which may be a track roller. The rotatable member 7 is rotatable in bearings 9 carried by relatively fixed structure 10.

The fixed structure 10 comprises an annular seal retainer 11 which coaxially surrounds the rotating members 7, 8 in radially spaced relation to them and which has an axially outwardly facing annular surface 12 that is surrounded by an axially outwardly projecting cylindrical wall 14. The rotating member 7 has a generally similar seal retaining portion defining an axially inwardly facing annular surface 15 surrounded by an axially inwardly projecting cylindrical wall 16 that is of substantially the same diameter as the cylindrical wall 14.

Each of the metal sealing rings 5*a*, 5*b* is of substantially L-shaped cross-section, so that each has a larger diameter portion 17 which is adjacent to the other sealing ring and a cylindrical smaller diameter portion 18 which projects axially away from the other sealing ring. The larger diameter portions 17 of the sealing rings 5*a*, 5*b* have marginal axially opposing annular surfaces that are lapped to near perfect flatness and are under axially convergent bias to provide a tight rotating annular seal 20 between those rings. A frustoconical elastomeric secondary seal ring 22*a* of a known type provides a sealed non-rotating connection between the metal seal ring 5*a* and the fixed seal retainer 11, and a similar elastomeric seal ring 22*b* provides a similar connection between the seal ring 5*b* and the seal retaining portion 15, 16 of the rotating member 7.

The elastomeric ring 22*a* is confined under radial compression between the cylindrical wall 14 of the seal retainer 11 and the cylindrical surface of the small diameter portion 18 of the seal ring 5*a*, to hold that seal ring coaxial to the seal retainer 11, prevent relative rotation between said seal ring and said seal retainer, and provide a non-rotating secondary seal between them. In a similar manner the elastomeric ring 22*b* secures the seal ring 5*b* in sealed, non-rotating concentric relation to the rotating member 7.

The elastomeric ring 22*a* also reacts axially between the axially outwardly facing annular surface 12 of the seal retainer 11 and the large diameter portion of the sealing ring 5*a*, to bias the latter axially outwardly, into sealing engagement with the metal sealing ring 5*b*. The elastomeric ring 22*b* similarly maintains an axially inward biasing force upon the metal sealing ring 5*b*.

The seal ring assembly 5*a*, 5*b*, 22*a*, 22*b* serves to confine lubricating oil in the cavity 23 that lies radially and axially inward of those rings, and thus the bearing 9, which is housed in that cavity, is always bathed in lubricant. Of course the seal assembly also prevents dirt and grit from entering the cavity 23.

Because the relatively rotating surfaces 20 comprise a seal, there is essentially no lubricant between them. Furthermore, the elastomeric rings 22*a*, 22*b* maintain those surfaces engaged under substantial axially convergent force. It will be apparent, therefore, that the rings 5*a*, 5*b* must possess great wear resistance in order to have a satisfactorily long useful life.

With proper heat treatment, as described hereinafter, seal rings like the rings *5a, 5b* can be made up from the alloy of this invention and will be hard enough for seal assemblies that are subject to high concentrations of grit and dirt and inexpensive enough for seal assemblies that are better protected.

In general, an alloy of this invention has the following composition, by weight:

| | |
|---|---|
| Carbon | 2.75–3.25% |
| Chromium | 18.00–22.00% |
| Molybdenum | 3.50–6.50% |
| Silicon | 1.00% max. |
| Manganese | 1.00% max. |
| Cobalt | 1.50–4.00% |
| Vanadium | 2.00% max. |
| Iron | Balance |

Sulfur, phophorous and tungsten, if present at all, should be present in no more than trace quantities, that is, there should not be substantially in excess of 0.04% of any of them.

A preferred formulation is as follows (by weight):

| | |
|---|---|
| Carbon | 3.00% |
| Chromium | 22.00% |
| Molybdenum | 5.00% |
| Silicon | 1.00% |
| Manganese | 1.00% |
| Cobalt | 2.00% |
| Vanadium | 1.50% |
| Iron | Balance |

In practical tests, common 1025 steel was used as the iron component.

While cobalt and molybdenum are present in the alloy of this invention, and have been found to be practically indispensable in an alloy having the hardness and abrasion resistance needed for the purposes here contemplated, it will be noted that these critical metals are incorporated in substantially smaller proportions than in prior alloys intended for the same purposes. As a result, a given allotment of cobalt and/or molybdenum can yield at least twice as much of the alloy of the present invention as of a prior alloy having comparable significant physical properties. It will also be noted that expensive tungsten is not included in the alloy of this invention, and that the vanadium content of this alloy is in line with that of prior abrasion resistant alloys.

One characteracteristic of the alloy of this invention distinguishes it significantly from the prior alloys discussed above. Those prior alloys display their characteristic hardness in the as-cast condition, whereas the alloy of the present invention must be heat treated in order to attain full hardness. As cast, the alloy of this invention is significantly softer than the prior alloys, usually having a hardness of less than 60 Rc.

From the standpoint of composition, the eesential absence of tungsten from the alloy of this invention distinguishes it from the most nearly comparable prior art alloy, the "CR-19" of U.S. Pat. No. 4,094,514. From the standpoint of physical properties, the softness of the present alloy in the as-cast condition is in contrast to "CR-19", which possesses its maximum hardness immediately upon being cast. Very probably the difference in physical properties is accounted for by the difference in composition with respect to tungsten. Apparently the tungsten in "CR-19" combines with some of the carbon in its composition to form tungsten carbide, which seems to contribute materially to the hardness of that alloy. As mentioned hereinabove, the absence of tungsten from the alloy of this invention affords the advantage of avoiding foundry problems encountered in the casting of alloys that contain tungsten. There is, of course, the very significant further advantage that, when heat treated, the present alloy is harder than "CR-19".

Two types of heat treatment can be used, herein designated a high temperature heat treatment and a low temperature heat treatment. The choice of heat treatment depends upon the nature of the article in which the alloy is embodied.

The high temperature heat treatment is conducted by heating the article until all portions of it attain 1750°–1800° F. (955°–980° C.) and then cooling it in air at ambient temperature.

The low temperature heat treatment is conducted by heating the article until all portions of it attain 950°–1025° F. (510°–550° C.) and then cooling it in air at ambient temperature.

The high temperature heat treatment affords greater hardness than the low temperature heat treatment, but it has the disadvantage that it can cause some distortion of larger parts. The relatively small (6 in. diameter and under) sealing rings used in so-called mud seals, which require the greater hardness obtained with the high temperature heat treatment, are not subjected to significant distortion by that treatment, whereas the larger sealing rings employed in final drive seal assemblies—which might be distorted by the high temperature heat treatment—are brought to a hardness that is very adequate for their function by means of the low temperature heat treatment.

It should be pointed out that because of metallurgical changes due to the respective heat treatments, the high temperature heat treatment causes some decrease in the size of the part, whereas the low temperature heat treatment causes some increase in the size of the part. The mold for a given part to be cast with the alloy of this invention should therefore be designed with allowances for shrinkage or expansion that are appropriate to the heat treatment to which the part is to be subjected.

For a test of the physical properties of the alloy of this invention in comparison to "Haynes 93" and "Haynes 589", a number of sets of sealing rings that were geometrically identical with one another were made up from these respective alloys. The sealings rings were essentially like the rings *5a, 5b* and were tested in a rig such as is represented by the accompanying drawing. The volume inside the seal was filled with SAE 30 oil as a bearing lubricant, while the seal was subjected at its exterior to a slurry made up of 25% fine dust, 25% coarse dust and 50% water (by weight). Seal rings were tested in like pairs, that is, the two rings of each tested pair were of like alloys and had been given similar heat treatments in the case of rings made with the alloy of this invention. Each pair of rings was tested for 104 hours—the first four hours without slurry, to check for oil leakage, and then 100 hours with slurry. Shaft speed was maintained at 320 rpm, and seal face load was maintained at 135 lbs.±10 lbs. To determine the volumetric wear that each seal ring sustained from the test, the density of the seal ring was determined before it was tested, and the ring was weighed before and after test to three decimal places in grams. Each ring was ultrasonically vapor degreased before each weighing. Wear determination was calculated as a volume change according to:

$$\text{Volume loss} = \frac{\text{Pretest ring weight (grams)} - \text{post-test weight}}{\text{Density } \frac{\text{(grams)}}{\text{(cc)}}}$$

The following data concerning wear were obtained:

| Alloy | Volumetric Wear ($cc \times 10^{-3}$) Minimum | Maximum | Calculated Average | No. of Tests (2 Rings per Test) |
|---|---|---|---|---|
| "Haynes 93" | 2.2 | 18.2 | 7.6 | 6 |
| "Haynes 589" | 1.3 | 139.0 | 37.8 | 6 |
| Invention - as cast | 51.6 | 59.8 | 55.7 | 1 |
| Invention - Low temp. | 18.2 | 48.7 | 33.0 | 2 |
| Invention - High temp. | 2.6 | 43.7 | 17.6 | 4 |

It can be seen that the alloy of this invention is greatly improved by heat treatment. With low temperature heat treatment it is somewhat superior to "Haynes 589" (and therefore also superior to "CR 19"), and it is thus more than adequate for final drive seals and similar applications that do not involve intensive exposure to grit. With high temperature heat treatment it is markedly superior to "Haynes 589", and although somewhat less wear resistant than "Haynes 93", it compares very favorably with that prior alloy and is well suited to heavy-duty applications that subject it to intensive grit exposure.

Corrosion tests were performed in addition to the wear tests. After a 24-hour salt spray test (ASTM-B117), the alloy of this invention was found by visual examination to be approximately equivalent in corrosion resistance to "Haynes 93" and "Haynes 589". In each case slight corrosion was evident on the lapped seal faces while severe corrosion was present on the "as cast" surfaces.

From the foregoing description it will be apparent that this invention meets a very urgent need by greatly increasing the quantity of abrasion-resistant alloy that can be made with a given quantity of critically scarce alloy metals and that the alloy of this invention nicely fulfills the requirements of a material suitable for the sealing rings of mud seal assemblies as well as those for the larger sealing rings of final drive seal assemblies.

What is claimed as the invention is:

1. A tough, abrasion resistant ferrous alloy heat hardened at either 1750° F. to 1800° F. or at 950° F. to 1025° F. consisting essentially of, by weight: from about 2.75% to about 3.25% of carbon, from about 18% to about 22% of chromium, from about 3.5% to about 6.5% of molybdenum, up to 1% of silicon, up to 1% of manganese, from about 1.5% to about 4% of cobalt, up to 2% of vanadium not substantially more than trace quantities of sulfur, phosphorous and tungsten, and the balance iron.

2. The alloy of claim 1 wherein the iron is derived from 1025 steel.

3. A method of producing a rigid, abrasion resistant member capable of moving relative to another similar member, in biased engagement therewith, to cooperate with said other member in providing a grit seal, said method being characterized by:

A. preparing an alloy having not substantially more than trace quantities of sulfur, phosphorous and tungsten in its composition and consisting essentially of, by weight,

| | |
|---|---|
| carbon | 2.75% to 3.25% |
| chromium | 18% to 22% |
| molybdenum | 3.5% to 6.5% |
| silicon | up to 1% |
| manganese | up to 1% |
| cobalt | 1.5% to 4% |
| vanadium | up to 2% |
| iron | balance; |

B. casting said member in unfinished form, from said alloy; and

C. heat hardening the member by a selected one of the procedures of (1) bringing the temperature of substantially all portions of the member to substantially 1750° to 1800° F. and then allowing the member to cool in air at ambient temperature, and (2) bringing the temperature of substantially all portions of the member to substantially 950° to 1025° F. and then allowing the member to cool in air at ambient temperature.

4. A tough ferrous alloy that can be made into a member which must move relative to another similar member while in biased engagement therewith and which is sufficiently abrasion resistant to cooperate with said other member in providing a durable grit seal, said alloy being heat hardened at either 1750° F. to 1800° F. or at 950° F. to 1025° F. and consisting essentially of, by weight: about 3% carbon, about 22% chromium, about 5% molybdenum, about 1% silicon, about 1% manganese, about 2% cobalt, about 1.5% vanadium, not substantially more than trace quantities of sulfur, phosphorous and tungsten, and the balance iron.

5. The alloy of claim 4 wherein said iron is derived from 1025 steel.

* * * * *